US005899362A

United States Patent [19]

Moran

[11] Patent Number: 5,899,362

[45] Date of Patent: May 4, 1999

[54] METHOD AND APPARATUS FOR COMBINING LIQUIDS

[76] Inventor: Michael J. Moran, 206 Mt. Pleasant Rd., New Bern, N.C. 28560

[21] Appl. No.: 08/847,117

[22] Filed: May 1, 1997

[51] Int. Cl.[6] ..... B67D 5/60

[52] U.S. Cl. ..... 222/136; 222/95; 222/389; 222/145.5; 239/373

[58] Field of Search ..... 222/136, 144.5, 222/145.1, 145.7, 145.5, 386.5, 389, 105, 95; 239/373, 337

[56] References Cited

U.S. PATENT DOCUMENTS

| | | | |
|---|---|---|---|
| 4,113,151 | 9/1978 | Brown et al. | 222/389 |
| 4,121,736 | 10/1978 | McGaw, Jr. | 222/136 |
| 4,723,688 | 2/1988 | Munoz | 222/185.1 |
| 5,526,957 | 6/1996 | Brown et al. | 222/389 |

FOREIGN PATENT DOCUMENTS

| | | | |
|---|---|---|---|
| 235437 | 9/1987 | European Pat. Off. | 222/144.5 |

*Primary Examiner*—Philippe Derakshani

[57] ABSTRACT

A proportional flow controller, having a combination of common-diameter, viscosity-insensitive orifices, accurately combines two or more liquids, for a range of flow rates. A common pressure is applied to all liquids causing equal pressure drops for the orifices, thereby ensuring stable flow ratios. Control is achieved without moving parts or electrical components, for flow rates low enough for spray painting and adhesive application. A flow passage junction, downstream of all orifices, provides for combining and discharging the liquids.

14 Claims, 10 Drawing Sheets

METHOD AND APPARATUS FOR COMBINING LIQUIDS

BACKGROUND

1. Field of Invention

This invention is directed to a method and apparatus for continuously combining two, or more, distinct liquids, while maintaining substantially fixed relative proportions, over a range of flow rates.

2. Description of Prior Art

The scope of field of this invention includes applications as diverse as medical treatment, manufacturing processes, and painting. A primary application of this invention is painting with high-performance two-part paints; an application that well illustrates the advantages and limitations of the prior art for combining liquids in specific proportions.

Such two-part paints typically consist of a pigment carrier as one component and a hardener as another component. These paints must be mixed in the proper proportions, at the time of, or shortly before, use. Prior art has solved the proportional combining problem associated with these paints in two effective ways.

One approach, most appropriately used when the required amounts of paint are small, is to premeasure the liquid components and package them in separate compartments that are joined, but have an impenetrable barrier between them. The barrier must be removed just prior to use, and the components combined and mixed to provide a paint that is suitable for immediate use. For example, U.S. Pat. Nos. 5,405,051 and 5,431,303 to Miskell (1995) disclose a dispenser wherein the reactive components are held in two separate containers and are maintained separate from one another by a heat-fusible plug in the first case and by a pierceable membrane in the second case. Removing the barrier permits the reactants to combine and mix.

Another example of this approach is found in U.S. Pat. No. 4,988,017 to Schrader, et. al. (1991) which discloses an aerosol container system with two separated chambers, containing liquids to be mixed just prior to use.

The advantages of using such premeasured and prepackaged products include:

(a) Eliminating the need for bulk handling and pouring of potentially toxic chemicals.

(b) The ability to purchase and store only small amounts of products with resulting economic and safety benefits.

(c) The ability to dispose of the package after use, greatly facilitating cleanup, and significantly reducing the use of cleaning solvents, with resulting environmental benefits.

(d) Light weight and small size, making a portable system practical.

This art, while workable, has the following severe disadvantages:

(a) Once the components are mixed, they must be used quickly, or they become useless. Similarly, any paint left over after job completion, being already mixed, is rendered useless. Since high-performance paints of the described type are expensive, this is seen to be a significant disadvantage.

(b) Since all of the liquids are mixed at the same time, the curing time begins immediately, thus the last of the paint to enter the spray nozzle has been reacting for the entire time of painting. If the painting is interrupted, or cleaning of the spray apparatus delayed slightly, cleaning can become unreasonably difficult or even impractical.

(c) Joined component packages preclude the ability to selectively combine components to achieve desirable characteristics, such as, for example, extra fast drying or hardening.

A second approach described in prior art is to continuously combine two or more components into a continuous stream, while maintaining fixed relative proportions. U.S. Pat. No. 4,440,314 to Vetter et al. (1984) and U.S. Pat. No. 4,176,672 to Borberg (1979) teach this approach through the use of controllers, flow transducers, and servo controlled pumps. A similar approach is taught by U.S. Pat. No. 4,019,653 to Scherer, et. al. (1977) which teaches actuated valves instead of servo controlled pumps to regulate component flow. The advantages of the approach taught in these patents are:

(a) Big jobs can be handled more conveniently than with pre measured and prepackaged components.

(b) Relative proportions of liquid components can be changed at will.

The following significant disadvantages are associated with this prior art.

(a) The expense of servo controlled metering, using controllers, transducers, etc. is very high for one work station.

(b) Such systems, being relatively bulky, heavy, and delicate, are not easily portable, and for practical purposes require fixed location usage.

(c) The amount of clean up required after use is significantly greater than that associated with prepackaged products. Correspondingly, the amount of cleaning solvent required is greater, with attendant cost and environmental penalties.

(d) The sensitivity of servo system components, and the harsh environment of industrial painting operations necessitate regular maintenance and calibration by skilled technicians.

(e) The use of electrically powered systems around solvent based painting operations requires extraordinary safety precautions.

OBJECTS AND ADVANTAGES

Accordingly, several objects and advantages of the present invention are:

(a) To provide for the use of prepackaged liquid components as desired, with all attendant advantages, as presented above; while restricting combining to those component portions being instantaneously used. Thus the time allowable for job completion is many times greater than with previous prepackaged component systems. Additionally, any remaining liquids can be stored for future use.

(b) To provide for the use of prepackaged liquid components, while supplying all downstream flow paths, as interior to a spray gun, for example, with an unreacted solvent-bearing mixture that continuously cleans rather than clogs.

(c) To provide for the use of prepackaged liquid components, while preserving the ability to selectively combine components to achieve desired characteristics, and while maintaining the ability to change the relative proportions as required by the chosen components.

(d) To provide for the use of prepackaged, selectively chosen cleaning solvents for in-place cleaning of fully assembled spray apparatus or applicators.

(e) To provide an on-demand, fixed-proportion, continuous blending system at very low cost, relative to systems employing measuring, metering, and control components.

(f) To provide a small, light-weight, and rugged liquid blending system that is easily portable and transportable.

(g) To provide a fixed-proportion continuous blending system requiring substantially less cleanup effort and cleaning solvent than do servo controlled systems.

(h) To provide a rugged and accurate blending system with disposable critical components, with no need for sophisticated maintenance and calibration.

(i) To provide a non-electric, demand type, liquid blending system, suitable for use in flammable or explosive environments.

Still further objects and advantages will become apparent from a consideration of the ensuing description and drawings.

DRAWING FIGURES

In the drawings, closely related figures have the same number but different alphabetic suffixes.

REFERENCE NUMERALS IN DRAWINGS

Figure 1A:
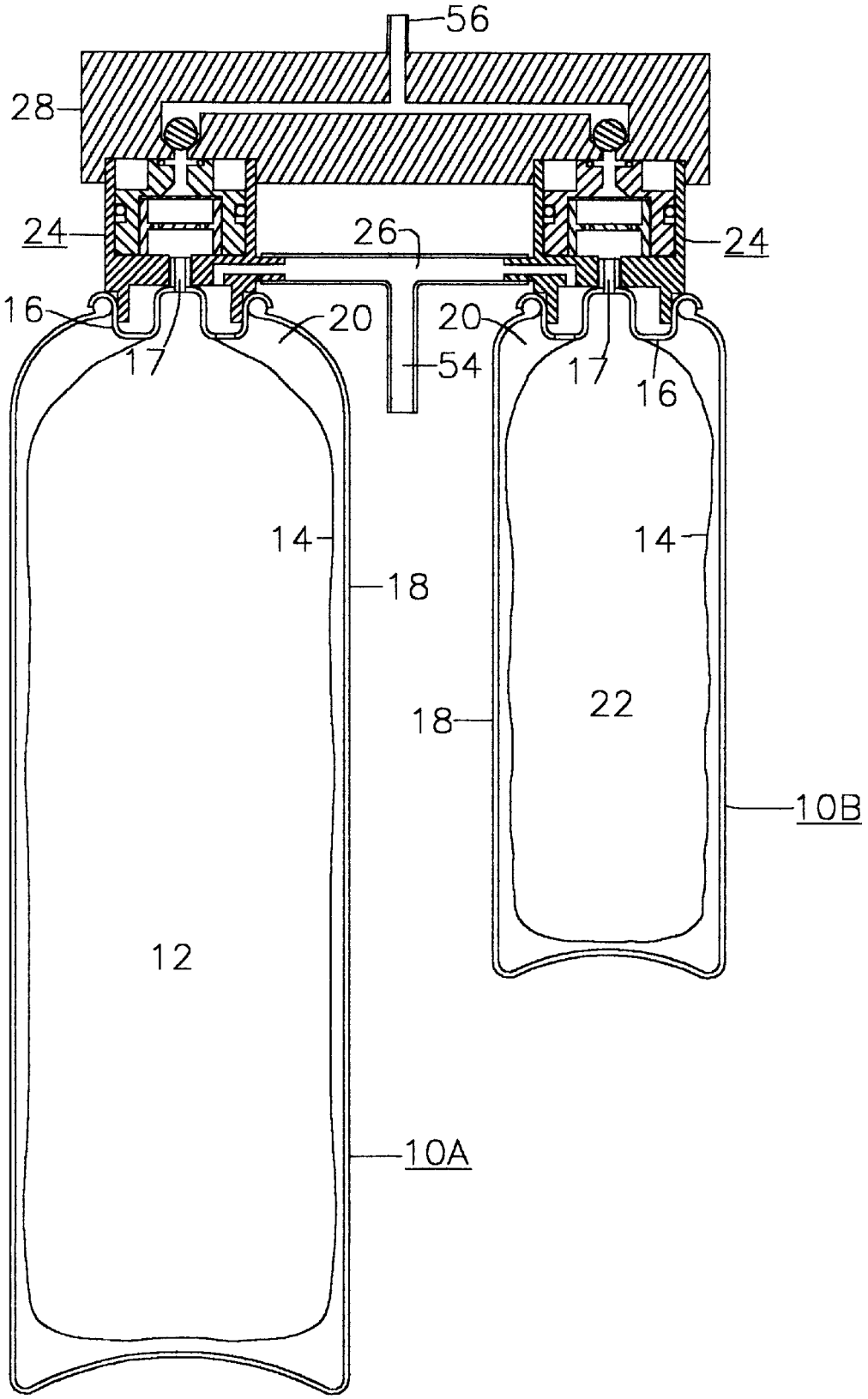
FIG. 1A is a cross-sectional view of a first embodiment of the present invention.

10A, 10B container
12 liquid
14 bag
16 cap
17 flow passage
18 can
20 cavity
22 liquid
24 orifice assembly
26 flow passage
28 manifold
30 outer housing
32 cavity
34 flow passage
36 aperture
38 seal
40 inner housing
42 flow deflector
44 web
46 apertures
48 orifice disk
50 orifices
52A, 52B, 52C flow passage
54 conduit
55 pressure charging valve
56 conduit
58 check valve
60A, 60B, 60C flow passage
62 head space
64 dip tube
66A, 66B container
68 seal
70 internal threaded port
72 externally threaded nipple
74 manifold
76 orifice assembly
78 flow passage
80 conduit
82 conduit Description—FIGS. 1A through 5C A preferred embodiment of the present invention is illustrated in FIG. 1A. Supporting, fastening, and aligning members, such as would be obvious to one skilled in the art, are omitted to enhance clarity. A container 10A, of the bag-in-can type, such as that taught by U.S. Pat. No. 5,169,037 to Davies, et. al. (1992), encloses a quantity of liquid 12 within a flexible bag 14. Bag 14 is attached, and sealed, to a cap 16 within a can 18, such that there exists a cavity 20 within can 18 and without bag 14. Bag 14 and cap 16 form a substantially impenetrable barrier between liquid 12 and cavity 20.

A container 10B, functionally identical to container 10A, although potentially of different capacity, contains a quantity of liquid 22, which is distinct from liquid 12.

An orifice assembly 24 is situated above, and sealed to, cap 16, in such a way as to provide a fluid tight flow path. Manifold 28 is mounted above all orifice assemblies 24 in such a way as to provide fluid tight flow paths for receiving and combining liquid streams flowing from containers 10A and 10B.

Passage 26 communicates with cavity 20 in container 10A and cavity 20 in container 10B.

Figure 2:
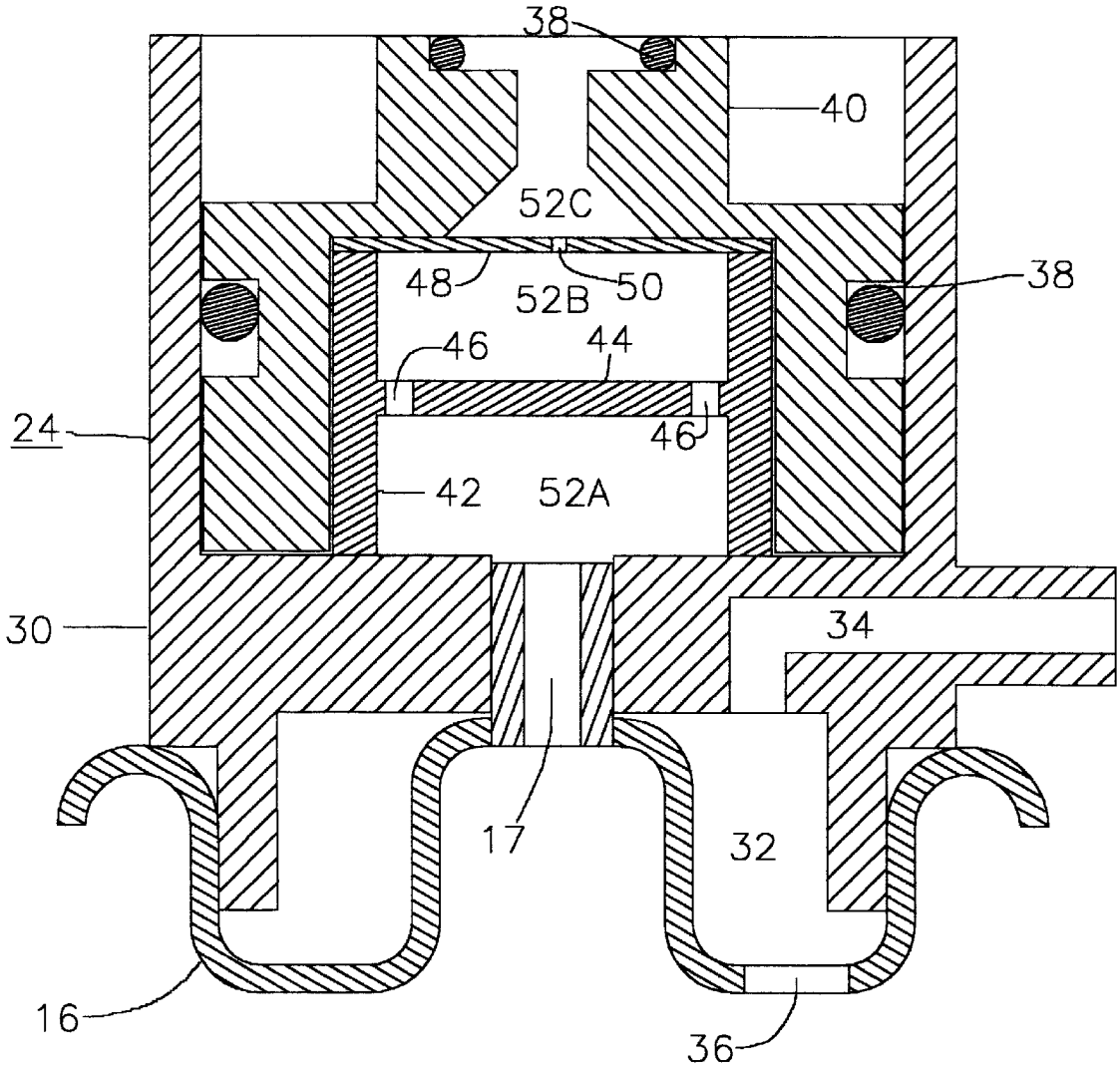
FIG. 2 is a cross-sectional view of critical flow path components.

FIG. 2 illustrates the component parts of orifice assembly 24 and their fit and relationship to cap 16. An orifice assembly outer housing 30 is pressed onto cap 16, forming a fluid tight fit at mating surfaces. An annular cavity 32 is thus formed. Passage 34 in housing 30 and aperture 36 in cap 16 provide access to cavity 32 from above and below.

Deformable, annular seals 38 are placed between selected surfaces to ensure fluid tight fits.

A flow deflector 42, with an annular outer wall and an internal web 44, is located within a cavity formed by outer housing 30 and inner housing 40. Deflector 42 is concentric with the flow path through assembly 24. Web 44 has a plurality of apertures 46, located around its periphery.

A disk 48 with one or more centrally located orifices 50 is clamped above flow deflector 42 by downward force of housing 40. The central cavity of housing 40 serves as flow passages 52A, 52B, and 52C.

Figure 4A:
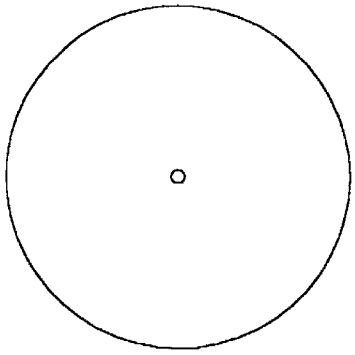
FIGS. 4A through 4D show preferred orifice patterns.
Figure 4B:
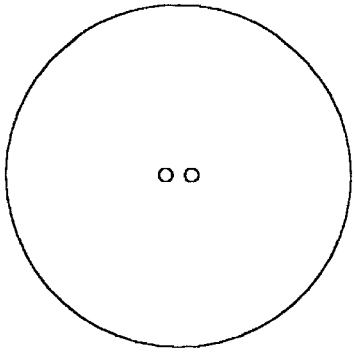
Figure 4C:
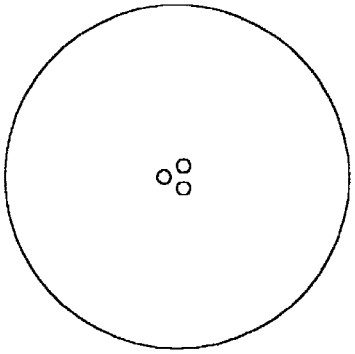
Figure 4D:
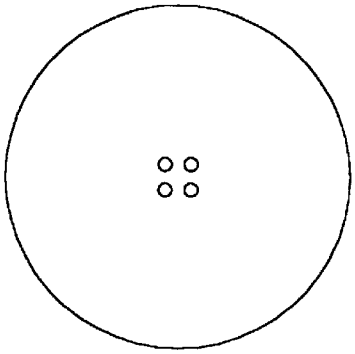
Figure 5A:
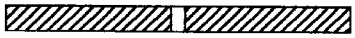
FIGS. 5A through 5C are cross-sectional views of preferred orifice geometry's.
Figure 5B:
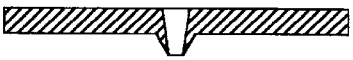
Figure 5C:
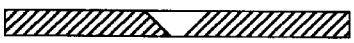

FIGS. 4A through 4D illustrate typical orifice patterns for one to four orifices. FIGS. 5A through 5C illustrate three preferred types of orifices. The significance of orifice numbers and shapes will be presented in the following operation description. A typical orifice configuration for container 10A, illustrated in FIG. 1A, is four orifices as shown in FIG. 4D, with each orifice having the shape illustrated in FIG. 5C. The corresponding orifice configuration for container 10B is one orifice as illustrated in FIGS. 4A and 5C. A typical diameter for each of the five orifices is 0.4 mm. Practical thicknesses for disk 48 range from 0.05 mm to several millimeters.

Each orifice assembly 24 can be preassembled and prepackaged with its respective container and liquid and flow path to provide convenience of use and cleanup and correct matching of orifices and liquid.

Figure 3:
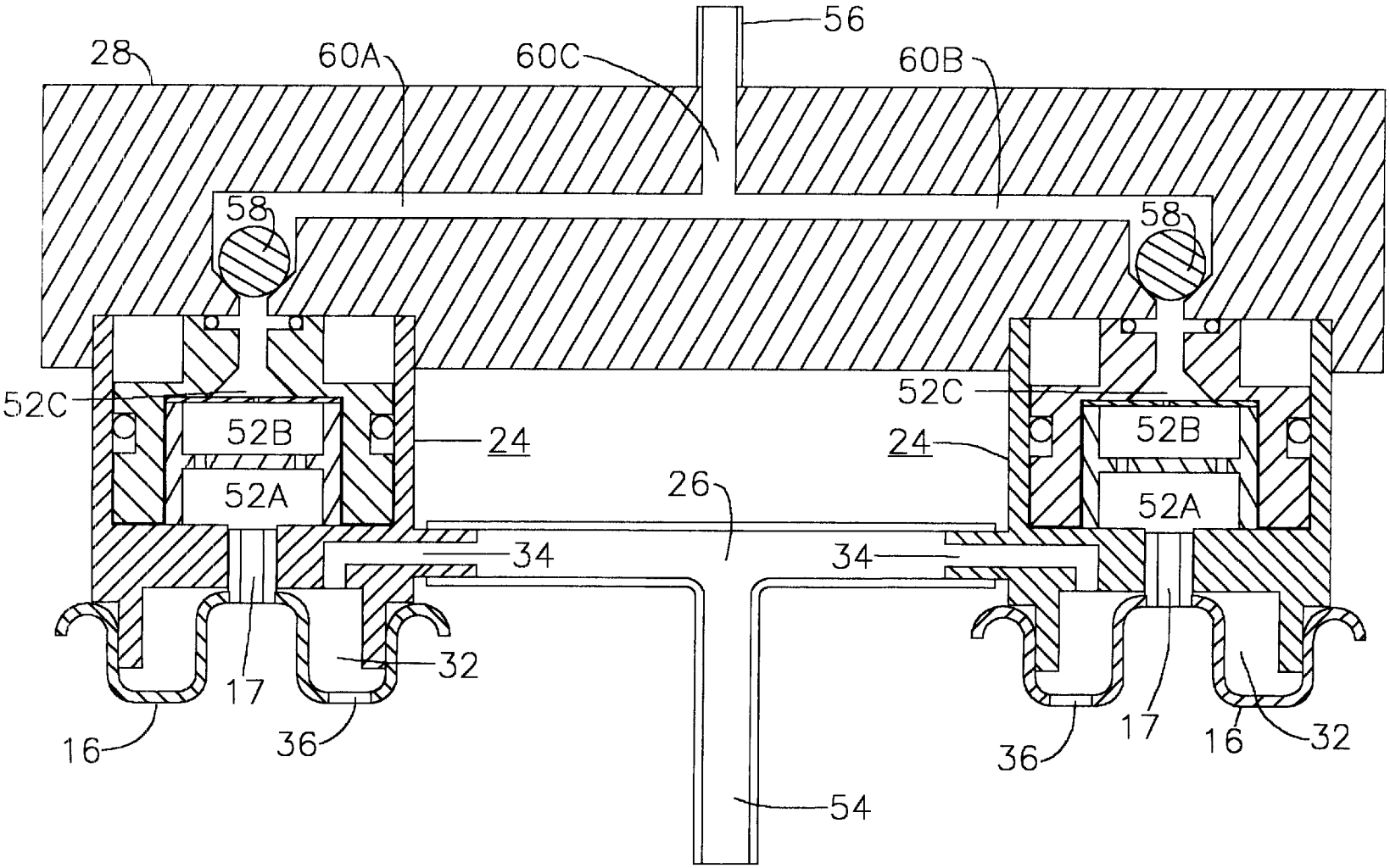
FIG. 3 is a cross-sectional view showing the assembly and interrelationships of all flow paths, fore embodiment of FIG. 1A.

FIG. 3 illustrates more clearly the interrelationships of the several component parts. Manifold 28 comprises flow passages 60A, 60B, and 60C, as well as exit conduit 56, and two check valves 58.

The flow path for each container, 10A or 10B, begins respectively in bag 14 and passes sequentially through passage 17, passage 52A, apertures 46, passage 52B, orifices 50, passage 52C, check valve 58, and then through either passage 60A or 60B to passage 60C for combining and discharging. Conduit 56 conveys the blended liquid to the next place of action or use. Obviously, conduit 56 can be configured for accessory attachment as necessary. For example, if the application is painting, the combined liquids would likely flow through a static mixing device (not shown) and then through a paint spray gun (not shown) for atomization and mixing with low pressure air, or other suitable gases. It is obvious that the triggered valve of a paint spray gun, or its equivalent, would permit user control of the total blended flow rate. Of course, there are many possibilities, determined by the specific application.

Figure 1B:
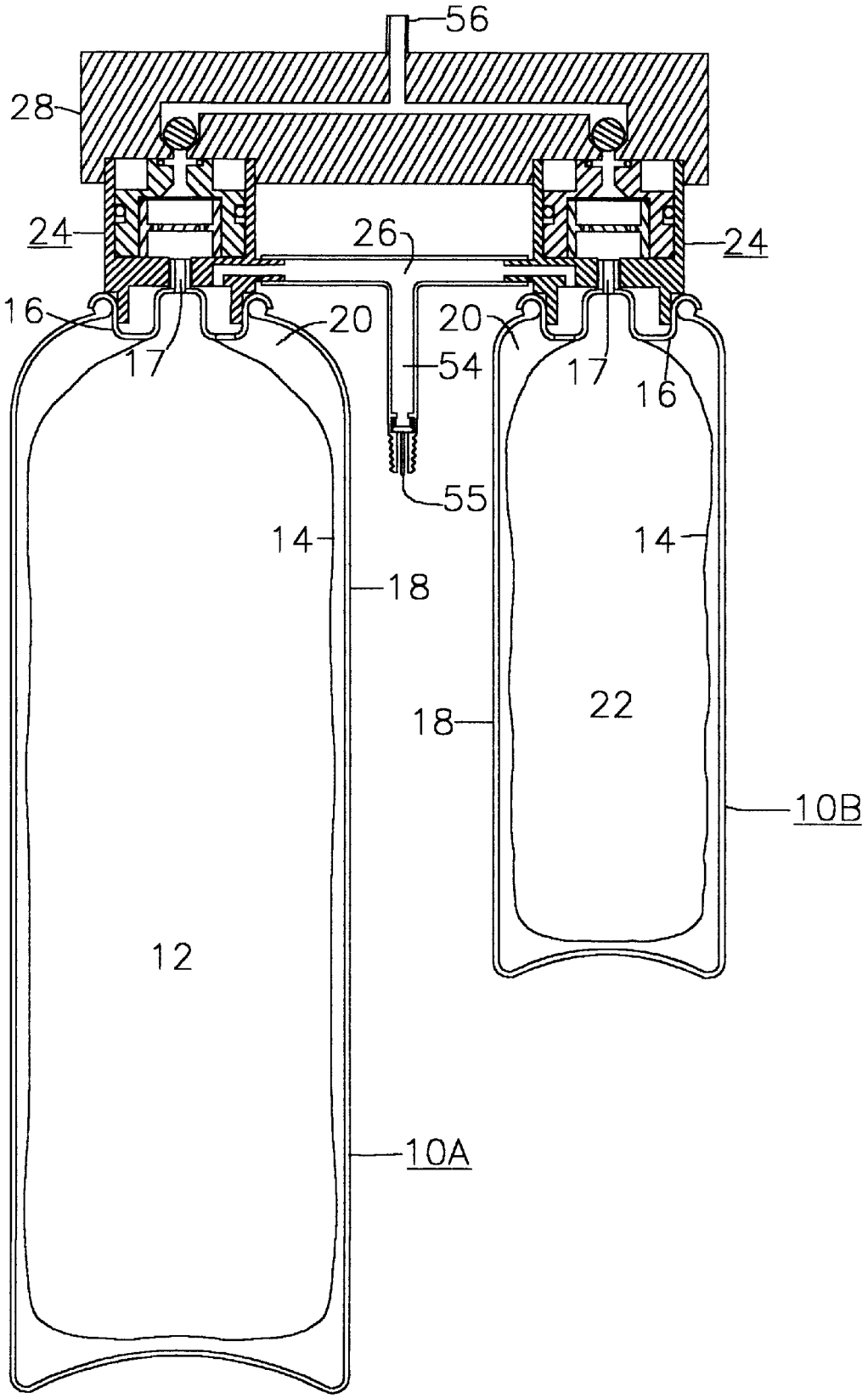
FIG. 1B is identical to FIG. 1A with the addition of a pressure charging valve.

FIGS. 1A and 3 illustrate an open fluid path from conduit 54 to cavity 20 of container 10A and cavity 20 of container 10B. The respective flow paths, beginning at passage 26, are sequentially through passage 34, cavity 32, aperture 36, and then into cavity 20. Conduit 54 supplies a substantially regulated common pressure, through a fluid medium, to each cavity 20. Conduit 54 may be supplied by a regulated-pressure air source, or by a regulated-pressure water source, for examples. In another embodiment as shown in FIG. 1B, conduit 54 attaches to a pressure charging valve 55, such as an air valve stem as is commonly found on automobile tires, for example. The valve enables initial charging and recharging of cavities 20 with a common pressure, eliminating an attached pressure line, and thus making a more portable and easy to use system.

Operation—FIGS. 1 through 5C

Though the following description is based upon two-liquid-component combining, it will be evident that the method, apparatus, and principles described are just as valid for applications requiring more than two liquid components.

The volumetric flow rate of a liquid through an orifice is given by the equation: $Q=C_dA_o\sqrt{2\Delta P/\delta}$, where the symbols are defined as follows:

Q is the volumetric flow rate, in milliliters per second, for example.

$C_d$ is the coefficient of discharge of the orifice. $C_d$ is an empirically determined factor, and is a function of the stream velocity, the viscosity of the liquid, and the diameter and entrance conditions of the orifice.

$A_o$ is the area of the orifice.

$\Delta P$ is the difference in pressure between the upstream and downstream sides of the orifice. It is $\Delta P$ that causes flow through the orifice.

$\delta$ is the mass density of the flowing liquid.

The operation of the embodiment illustrated in FIGS. 1A through 3 is based upon a judicious application of the preceding orifice flow rate equation. In the following, the flow rate equation parameters for container 10A are designated by the subscript 1; those for container 10B are designated by the subscript 2.

For optimum performance all restrictions to flow, for example, passages 17 and apertures 46, as shown in FIG. 2, should be significantly larger in area than controlling orifices 50, for each flow path. Results will usually be satisfactory if all flow path effective diameters are twice the effective diameters of orifices 50. Smaller diameters tend to mask the effect of controlling orifices, and make it more difficult to set flow rate proportions. Specifically, smaller passages effectively combine with controlling orifice restrictions to make an equivalent orifice that is smaller than the actual area A. used in the above equation.

It can be appreciated from a consideration of FIG. 1A that the pressure of liquid 12, and correspondingly of liquid 22, is the same as that in cavities 20, because of the flexible nature of bags 14. It then follows from an examination of FIGS. 2 and 3 that, if the flow path channels are large enough, the pressure in each flow passage 52B will be at each instant effectively identical to the supplying pressure in conduit 54. Likewise it is evident that the pressure in each flow passage 52C is effectively the same as the pressure in passage 60C, where the streams combine. Thus the pressure difference across orifices 50 for container 10A, is for each instant, identical to the pressure difference across orifice 50 for container 10B.

A study of FIGS. 1A through 3 shows that the pressure in passage 60C is determined by conditions downstream of conduit 56, thus the method and apparatus under consideration constitute a "supply on demand" proportionality controller. Thus, if a paint spray gun is attached downstream of conduit 56, the spray gun trigger will determine the instantaneous flow rate, within the range of no flow, to the maximum flow that can be obtained by the pressure in conduit 54.

To be effective, the method and apparatus must maintain a substantially constant ratio of flow $Q_1$ to flow $Q_2$, for example, 4:1. Using the above flow rate equation it follows that the instantaneous ratio of flows is:

$$\frac{Q_1}{Q_2}=\frac{C_{d1}A_{o1}\sqrt{2\Delta P/\delta_1}}{C_{d2}A_{o2}\sqrt{2\Delta P/\delta_2}}=\frac{C_{d1}A_{o1}\sqrt{\delta_2}}{C_{d2}A_{o2}\sqrt{\delta_1}}$$

For practical purposes the ratio $\sqrt{\delta_2}/\sqrt{\delta_1}$ is substantially constant, and in most cases is close to 1. Thus the ratio of flows $Q_1$ and $Q_2$ is shown to be proportional to $$\frac{C_{d1}A_{o1}}{C_{d2}A_{o2}}.$$

Orifices 50, as shown in FIG. 2, are of constant size, and the ratio $A_{o1}/A_{o2}$ is always constant.

Thus the proportionality is reduced to $$\frac{Q_1}{Q_2}\propto\frac{C_{d1}}{C_{d2}}.$$

It follows that, if the ratio $C_{d1}/C_{d2}$ can be held constant within acceptable tolerances, the instantaneous ratio of flows remains substantially constant for a range of flows.

At high flow rates, with fully developed turbulent flow, values of $C_d$ are essentially constant for sharp edged orifices, such as FIG. 5C for example. For such conditions, two orifices of differing diameters can be used to set and maintain a fixed component flow ratio. However, most applications for the present embodiment will require much lower flow rates. A typical working flow rate range for painting is 1 milliliter per second to 4 milliliters per second, for example. Flow in this range is completely laminar for the present example. For flow in this range the orifice coefficient of discharge $C_d$ is a non-linear function of the above mentioned flow parameters. In such cases, the use of different diameter orifices 50 results in unacceptable variation in the ratio $C_{d1}/C_{d2}$, and thus in the ratio of flows, as the total flow rate varies.

The ratio $C_{d1}/C_{d2}$ can be made much more nearly constant by using combinations of orifices having a common diameter. The above description of this embodiment used, as an example, 4 orifices, in parallel, as shown in FIG. 4D for container 10A. The corresponding orifice configuration for container 10B was given as 1 orifice as shown in FIG. 4A. With this combination the proportion of flow rates would be substantially 4 to 1. Using orifices with the same, or nearly the same, diameters results in similar flow conditions at all orifices. With similar flow conditions, as the flow rate changes, the $C_d$'s of the separate flow paths will vary in such a way that the ratio $C_{d1}/C_{d2}$ remains nearly constant.

Sharp edged orifices, such as shown in FIG. 5C, are well known to be relatively insensitive to viscosity as compared to the orifice type of FIG. 5A. The orifice shape illustrated by FIG. 5B is an approximation of a type of orifice known as a Borda's mouthpiece. This orifice geometry, also, reduces sensitivity to viscosity and to upstream flow conditions. Viscosity is temperature sensitive; the use of viscosity insensitive orifices, such as those described above, renders the present invention insensitive to temperature variations within the working range of the blended liquids.

It is well known, in the science of fluid flow, that the sensitivity of $C_d$ to changes in flow parameters is dependent upon the ratio of the effective orifice diameter to the upstream flow passage diameter. Specifically, if the ratio is large, 0.8 for example, the sensitivity is greater, but if the ratio is small, 0.1 for example, the sensitivity is smaller. Additionally, for two or more parallel flow paths with different effective orifice diameters, as in the present invention, larger anterior passages result in more nearly identical and smaller sensitivities for the various $C_d$'s. If the ratio of effective orifice diameter to anterior passage diameter is approximately 0.1 or less, for the various parallel flows, the resulting ratios of $C_d$'s will be essentially constant over the working flow rate range.

Thus for the apparatus , and example, illustrated in FIG. 1A, the equivalent orifice diameter of the combined 4 orifices of 0.4 mm is 0.8 mm. To gain the constant ratio of $C_d$'s as discussed above, the corresponding anterior passage 52B would require a diameter of at least 8 mm. The corresponding single orifice for container 10B, with a 0.4 mm orifice and 8 mm anterior passage would have a ratio of 0.05. Thus both ratios being 0.1, or less, the resulting ratio of $C_d$'s would be essentially constant for the flow range. Flow deflector 42, shown in FIG. 2, serves to provide a large anterior passage, and further provides for radially inward flow, because of apertures 46, which increases the effective diameter over the actual diameter. Web 44 further shields orifices 50 from upstream disturbances, while providing for radial flow through apertures 46.

Check valves 58, as shown in FIG. 3, prevent back flow into either container, due to siphoning or change in attitude, at times when the blended flow is stopped. The valves 58 are not needed for all applications, and are not necessary at all for controlling component proportions.

Thus, the method of the present invention is to:

(a) Apply an instantaneously identical pressure to two or more liquids.

(b) Provide a substantially unrestricted flow path for each liquid up to a controlling fixed orifice configuration, with a sufficiently large anterior passage preceding the orifice configuration.

(c) Provide a viscosity insensitive controlling orifice configuration for each liquid, based on combinations of common diameter orifices, such that the ratios of $C_d$'s for the several orifice configurations remain substantially constant for the working flow rate range, and the working temperature range, and the proportions of the combining liquids is satisfactory.

(d) Provide a substantially unrestricted flow path from each liquid's orifice configuration to the point of combining, thereby ensuring instantaneously identical $\Delta P$'s across all controlling orifices.

This method, as implemented in FIG. 1A, has demonstrated excellent proportion control, while combining a two-part paint. A paint with a viscosity of 7 centipoise, and a hardener with a viscosity of 30 centipoise, were blended in a 4 to 1 ratio. Conduit 56 led to a commonly available paint spray gun. Conduit 54 was supplied with 20 psi air. For a working flow rate range of 1 to 4 milliliters per second, the 4 to 1 proportionality was maintained within a ±2.6% tolerance.

Figure 6:
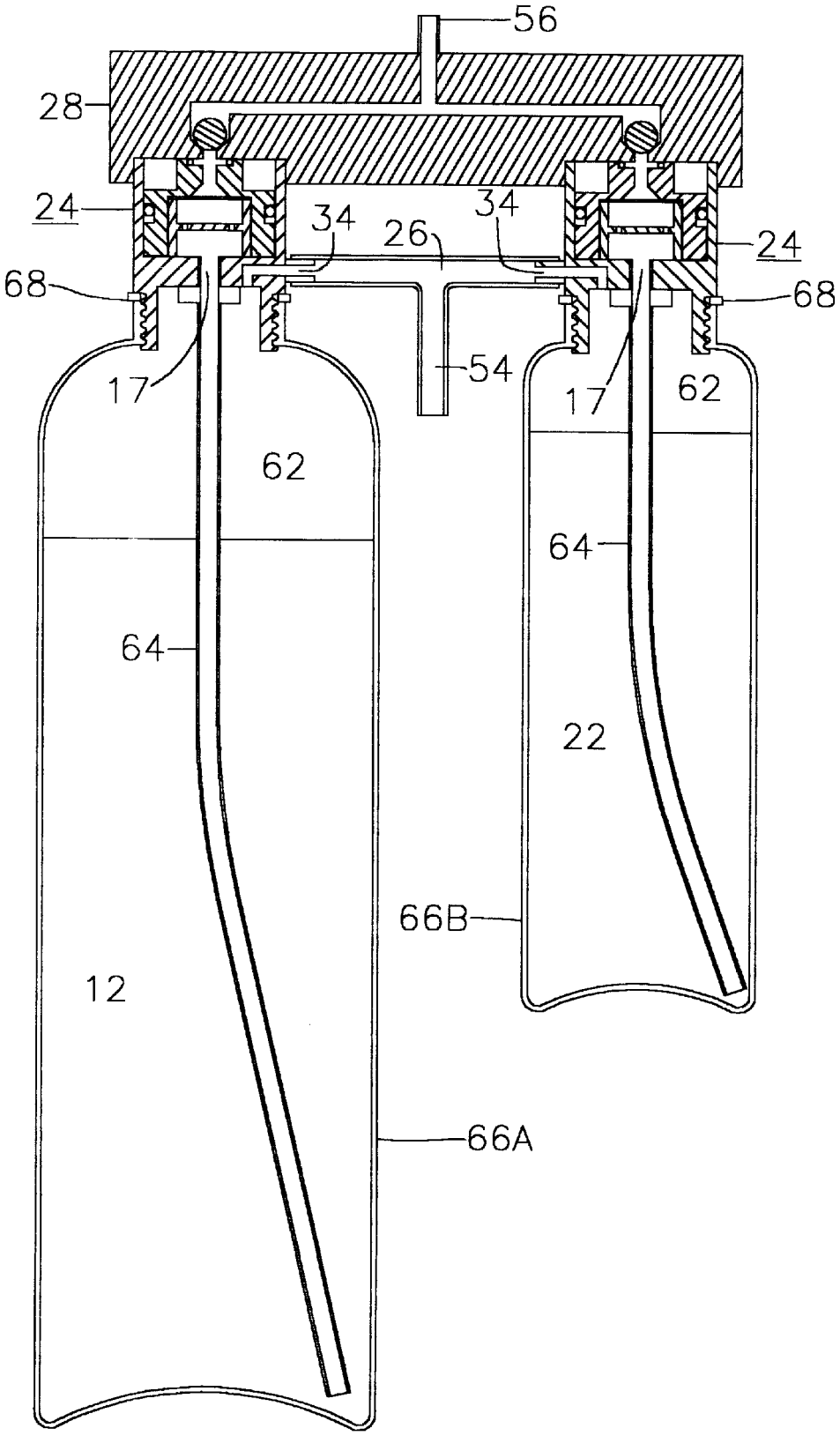
FIG. 6 is a cross-sectional view of a second embodiment of the present invention.
Figure 7:
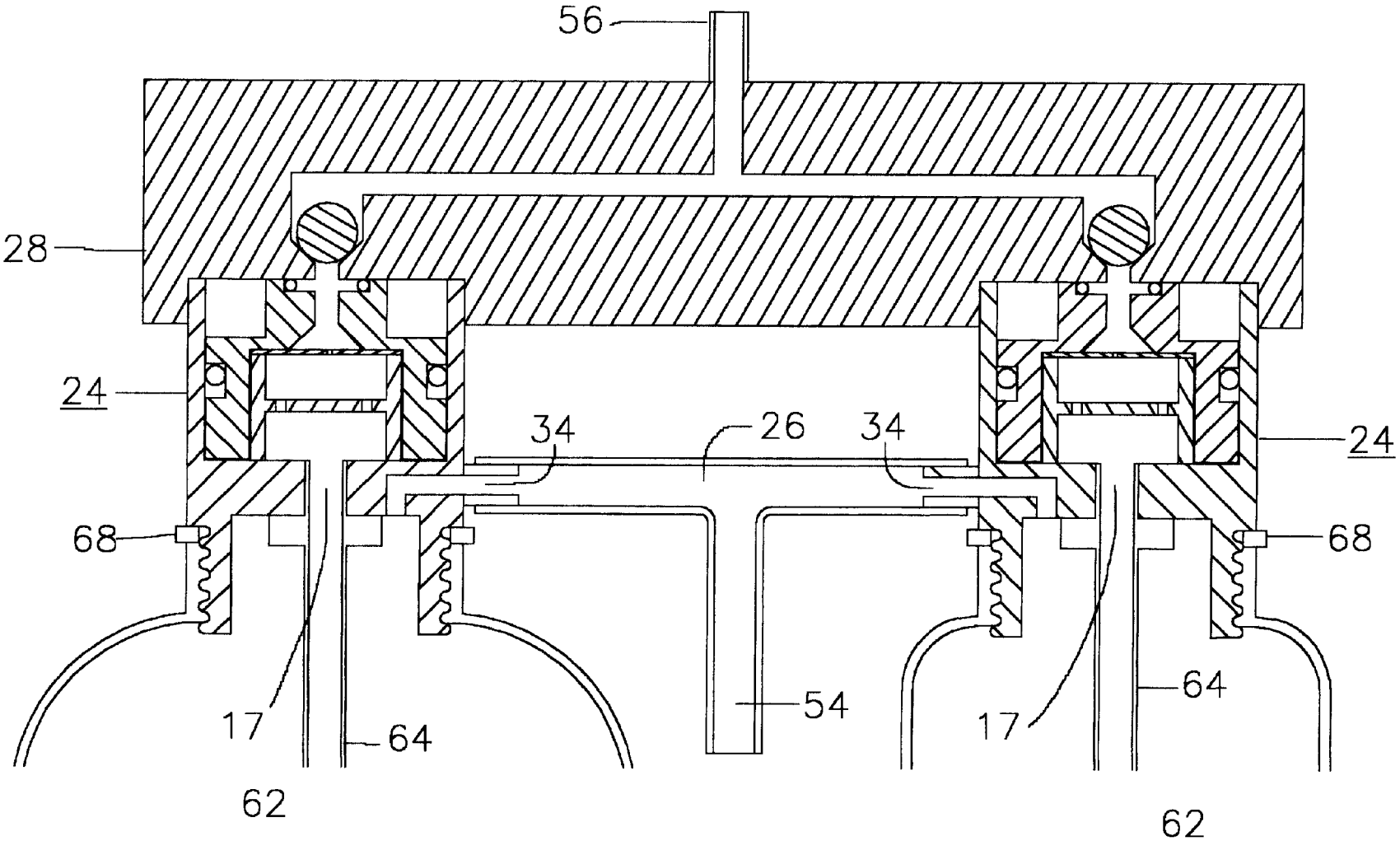
FIG. 7 is an enlarged view of a portion of FIG. 6, showing clearly all flow paths.

Description—FIGS. 6 and 7

A second embodiment is illustrated in FIG. 6. A reusable container 66A encloses a quantity of liquid 12. Seal 68 forms a fluid tight interface between container 66A and orifice assembly 24. A head space 62 contains a pressurizing gas supplied through conduit 54. Head space 62 of the present embodiment is functionally equivalent to cavity 20 of the first embodiment, as illustrated by FIG. 1A, except the pressurizing gas is in intimate contact with liquid 12. It is therefore necessary that the gas in head space 62 be inert with respect to all liquid components. For example, nitrogen gas would be satisfactory for most paints.

A dip tube 64 extends from flow passage 17 to near the bottom of container 66A.

A container 66B, functionally identical to container 66A, although potentially of different capacity, contains a quantity of liquid 22 which is distinct from liquid 12.

Containers 66A and 66B are different from containers 10A and 10B of the first embodiment, since they can be removed for cleaning and refilling, and can in practice be any size desired. Containers 10A and 10B are more suited for prepackaging and after use disposal.

As illustrated in FIG. 7, the remainder of the present embodiment is identical to the first embodiment as previously described.

Operation—FIGS. 6 and 7

The operation of this embodiment is identical to that of the previously described embodiment, except in the means by which liquids 12 and 22 are supplied to their respective flow passages 17. The pressure in conduit 54 is at each instant identical to that in each head space 62. Whenever this pressure exceeds that in conduit 56, liquids 12 and 22 are forced upward through their respective dip tubes and thus through flow passages 17 and the previously described flow paths.

The flow rate ratio is determined and maintained as described previously for the first embodiment.

Figure 8:
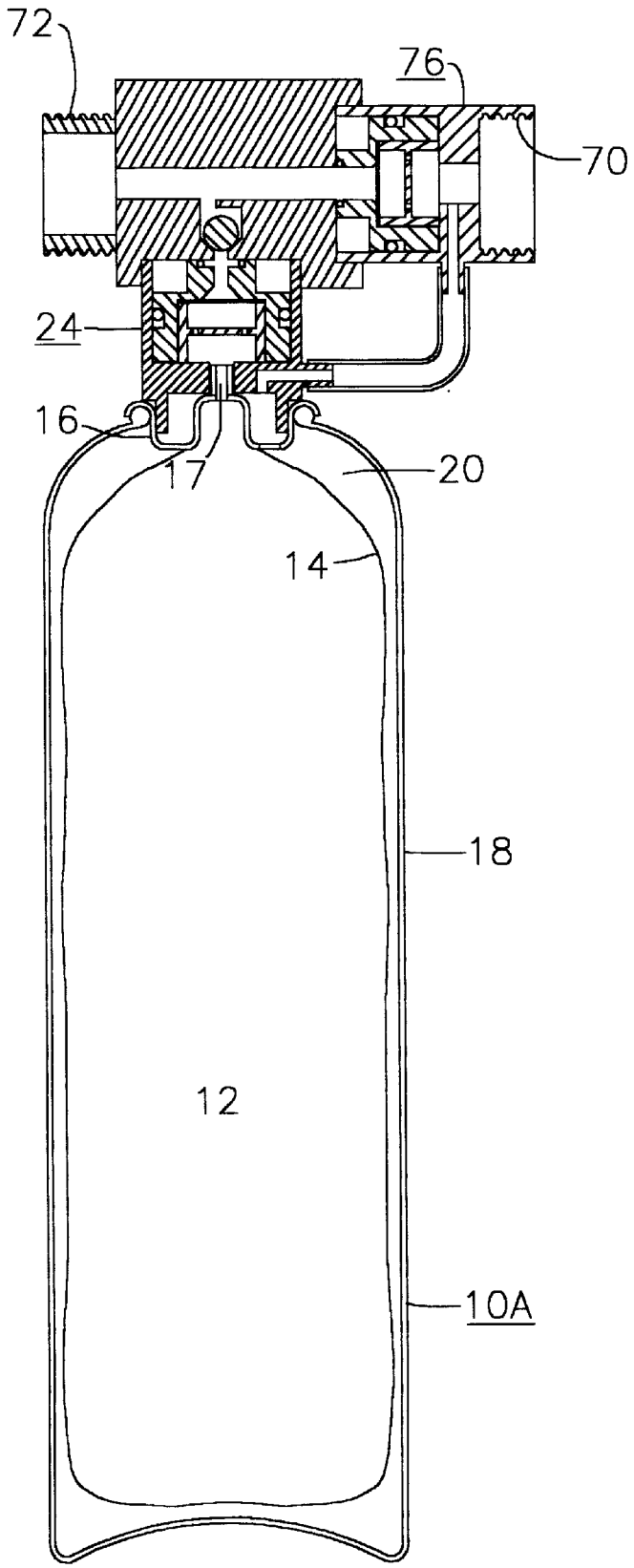
FIG. 8 is a cross-sectional view of a third embodiment of the present invention.
Figure 9:
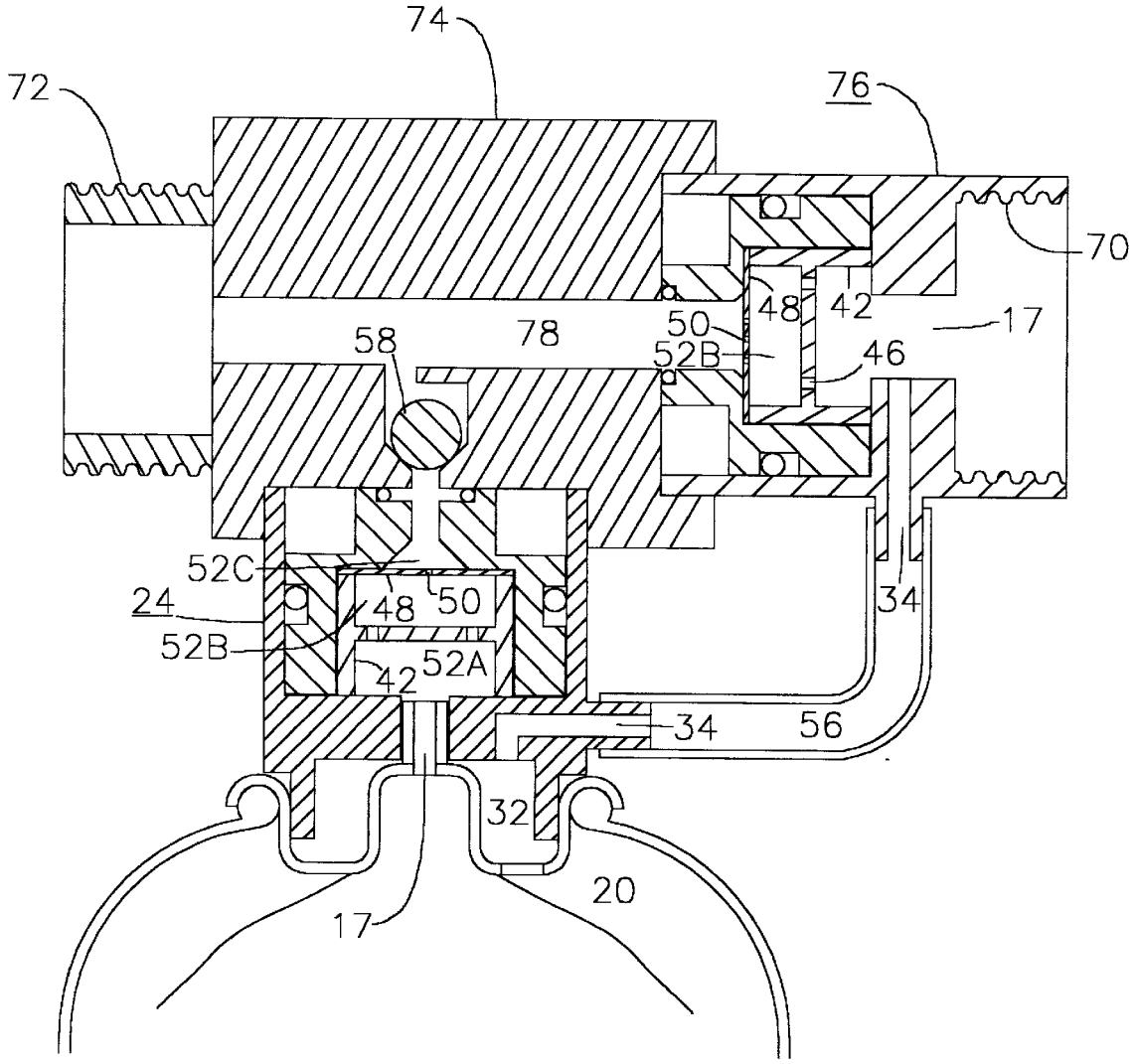
FIG. 9 is an enlarged view of a portion of FIG. 8, showing clearly all flow paths and their interrelationships.

Description—FIGS. 8 and 9

A third embodiment of the present invention is illustrated in FIGS. 8 and 9. Container 10A of the bag-in-can type encloses a quantity of liquid 12 within a flexible bag 14. Bag 14 is attached, and sealed, to a cap 16 within a can 18, such that there exists a cavity 20 within can 18 and without bag 14. Bag 14 and cap 16 form a substantially impenetrable barrier between liquid 12 and cavity 20.

An orifice assembly 24, identical to that described for the first embodiment, is situated above, and sealed to, cap 16, in such a way as to provide a fluid tight flow path.

A manifold 74 is mounted above orifice assembly 24 with a fluid tight connection, as shown in FIG. 9. Internal to the manifold is a check valve 58 preventing flow into container 10A.

An externally threaded nipple 72 is attached to manifold 74, as shown in FIG. 9. The nipple is suitable for threading into a spray-nozzle valve, such as is commonly used with garden hoses, for example.

An orifice assembly 76 is attached with a fluid tight fit to manifold 74. Assembly 76 is identical in every way to the previously described orifice assembly 24, except for the portion upstream of flow passage 17. Where orifice assembly 24 is suitable for a fluid tight connection to container 10A, orifice assembly 76 has an internally threaded port 70 suitable for attaching to a pressurized liquid source, such as a common garden hose, for example.

Flow passage 34 in orifice assembly 76 and flow passage 34 in orifice assembly 24 communicate through conduit 56 to share a common pressure.

Manifold 74 contains an internal flow passage 78 which joins the flow paths through orifice assemblies 24 and 76, and provides an exiting flow path through threaded nipple 72.

Operation—FIGS. 8 and 9

The current embodiment maintains a constant flow rate ratio in the same way as the previous embodiments. This embodiment differs, however, in the method of providing an instantaneously equal pressure drop across the control orifices 50 in orifice assemblies 24 and 76.

Typically, a water hose would be screwed into port 70. If pressurized water is supplied to flow passage 17 in assembly 76, flow passage 34 will transmit only the static pressure, since it is perpendicular to the flow through passage 17. The static pressure is thus communicated sequentially through conduit 56, flow passage 34 of assembly 24, annular cavity 32, and into cavity 20 of container 10A.

Since the pressure of liquid 12 in container 10A is instantaneously equal to the static pressure of the water in orifice assembly 76, and since the two flow paths join and have a common pressure in flow passage 78, the flow rate of liquid 12 and the flow rate of water will maintain a substantially constant ratio for a range of flow rates, as previously described for the operation of the first embodiment.

Liquid 12 flow and water flow will combine in flow passage 78 and flow out through threaded nipple 72 and thereafter through a suitable spray-nozzle and valve.

Figure 10:
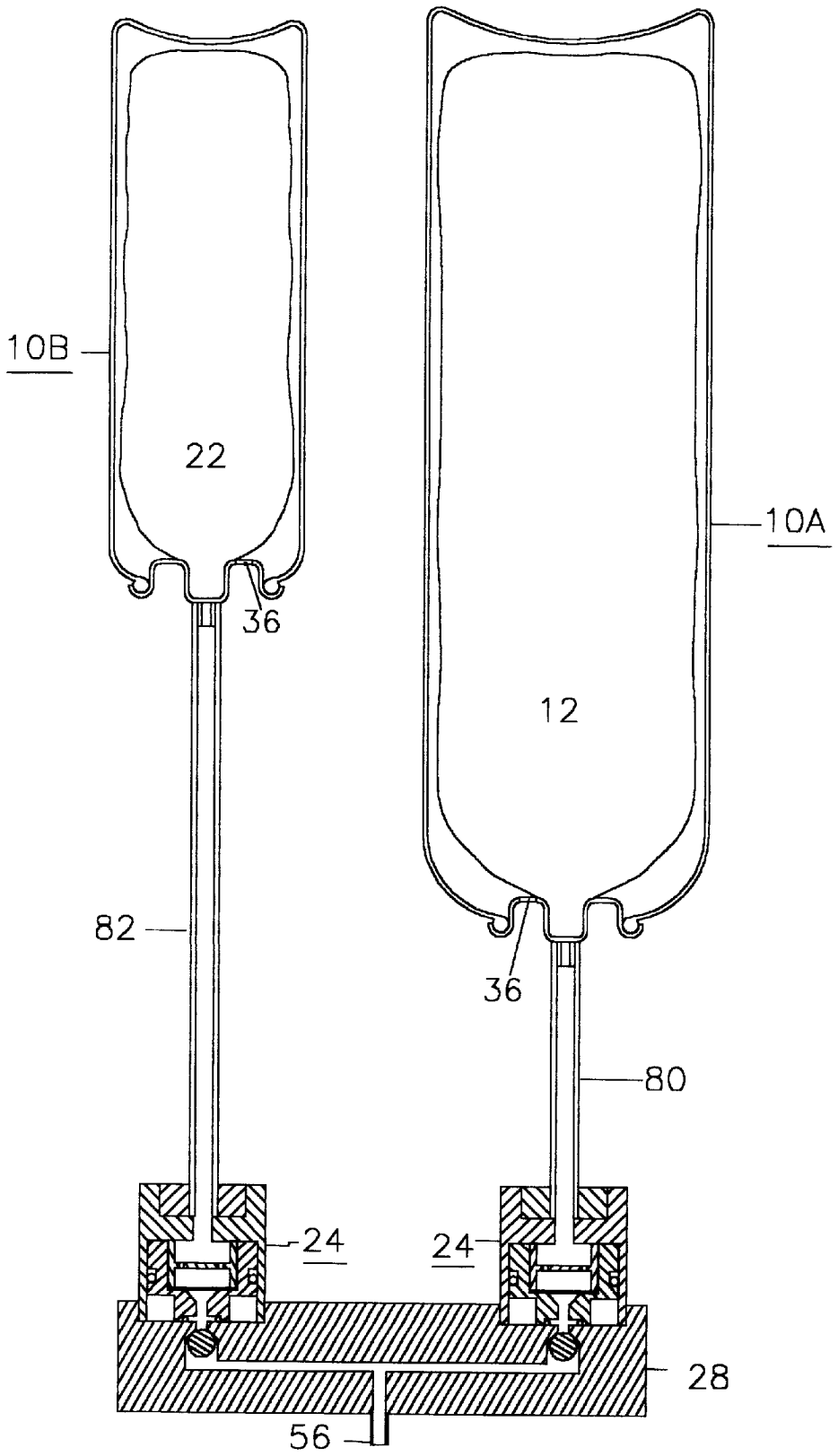
FIG. 10 is a cross-sectional view of a fourth embodiment of the present invention.

Description—FIG. 10

A fourth embodiment of the present invention is shown in FIG. 10. Containers 10A and 10B are of the bag-in-can type and are as described for the first embodiment. The containers enclose respectively liquids 12 and 22 as previously described.

Containers 10A and 10B are inverted as shown in FIG. 10 to permit gravity flow. Container 10A communicates with its orifice assembly 24 through conduit 80. Container 10B communicates with its orifice assembly 24 through conduit 82. Manifold 28 and assemblies 24 are as described for the first embodiment, except that assemblies 24 receive conduits 80 and 82, as shown, with fluid tight fits, instead of joining directly to containers 10A and 10B. Conduits 80 and 82 may be rigid or flexible, straight or curved with no change of functionality.

Apertures 36 communicate ambient atmospheric pressure to liquids 12 and 22. It will be appreciated that containers 10A and 10B may be replaced with liquid filled flexible bags, such as are used for medical intravenous solutions, with no loss of fuinctionality.

Operation—FIG. 10

The current embodiment maintains a constant flow rate ratio in the same way as the previous embodiments. This embodiment differs, however, in the method of providing a common pressure at the upstream faces of the several orifices of assemblies 24.

Liquids 12 and 22 are maintained at ambient atmospheric pressure through apertures 36. Since liquid in conduit 56 will usually have a pressure at least as great as the ambient atmospheric pressure, there will be no flow unless additional pressure is applied upstream of the orifices. The necessary additional pressure is supplied by the weight of liquid above each orifice. If the height of the liquid column above each orifice is properly chosen, each orifice will share a pressure in common with all other orifices. In order to establish the proper relative heights, the relative densities of the liquids must be taken into account.

If the desired common orifice face pressure head is P centimeters of water, the above orifice height required for each liquid is given by P/s.g., where s.g. is the specific gravity of the respective liquids. For example, if the desired pressure head is 50 cm $H_2O$, and one of the liquids has a specific gravity of 0.9, the required height is 50/0.9=55.5 cm. If a second liquid has a specific gravity of 1.1, its required height is 50/1.1=45.4 cm.

With liquid heights properly established, this embodiment, as illustrated in FIG. 10, will provide flow ratio regulation in the same manner as the first embodiment, but without the requirement of an external pressure source.

Summary, Ramifications, and Scope

Accordingly, the reader will see that the flow ratio regulating method and apparatus of this invention can be used to accurately combine flows with an economy and convenience not obtainable with prior art. Specifically, for a working flow rate range suitable for paint spraying applications:

- it provides great economic savings over methods utilizing feedback controllers with electrically active components.
- it avoids the bulk, weight, and delicateness of such feedback controllers.
- it eliminates the maintenance and calibration by skilled technicians required by such controllers.
- it eliminates the hazards caused by electrical usage in potentially explosive atmospheres.
- it significantly reduces the amount of after use cleaning, and therefore the amount of solvent used, with time, cost, safety, and environmental benefits.
- it eliminates bulk handling of potentially toxic chemicals.
- it permits after use disposal of prepackaged units.
- it permits saving unused liquids.
- it greatly extends the allowable working time over prior prepackaged systems.
- it permits selective combining of liquid components to achieve tailored characteristics, an option not available with prepackaged and prejoined components.

Although the descriptions above contain many specificities, these should not be construed as limiting the scope of the invention but as merely providing illustration of some of the presently preferred embodiments of this invention. For example, the described embodiments can be use in conjunction with a paint spray gun, air brush, adhesive applicator, liquid spray nozzle, etc.

The scope of usage is very broad, including, but not limited to:

supplying nutrients to animal watering systems.

dispensing pesticides.

constructing economical, small liquid rocket motors.

cleaning and disinfecting animal husbandry buildings and lots.

dispensing medical intravenous solutions.

purifiing water, especially in disaster areas.

combining algae and/or rust inhibitors, etc., with industrial process liquids.

Accordingly, the scope of the invention should be determined not by the embodiments illustrated, but by the appended claims and their legal equivalents.

I claim:

1. A method for predetermining and maintaining combining proportions for two or more simultaneously flowing liquids, comprising the steps of:

a. applying a common pressure to said liquids, for providing flow on demand, and b. providing a separate flow path in combination with a plurality of viscosity insensitive orifices of substantially common and relatively small diameter, for each of said liquids, whereby the coefficients of discharge of said orifices, for any of said liquids, maintain a substantially constant ratio relationship with those of said orifices associated with any other of said liquids, throughout the working flow rate range, and c. joining the several flow paths, downstream of all said orifices, for combining and discharging said liquids, whereby the relative proportions of the combining liquids remain substantially constant over the working flow rate range and working temperature range.

2. A controller for proportionally combining two or more simultaneously flowing liquids comprising:

a. containers, separately enclosing said liquids, in combination with a pressurizing means for providing a common pressure to said liquids, and b. a separate flow path in combination with a plurality of viscosity insensitive orifices of substantially common and relatively small diameter, for each of said liquids, whereby the coefficients of discharge of said orifices, for any of said liquids, maintain a substantially constant ratio relationship with those of said orifices associated with any other of said liquids, throughout the working flow rate range, and c. a junction of all flow paths, downstream of all said means for all said orifices, for combining and discharging said liquids, whereby the relative proportions of the combining liquids remain substantially constant over the working flow rate range and working temperature range.

3. The controller of claim 2 further including a check valve for preventing back flow, incorporated into each flow path, upstream of said flow path junction, whereby contamination of said liquids is prevented.

4. The controller of claim 2 further including a substantially impermeable, flexible bag in each of said containers, separating said liquids from said pressurizing means, whereby contamination of said liquids is prevented, pressurization is unimpeded, and upward flow is enabled.

5. The controller of claim 2 further including a dip tube in each of said containers, whereby upward flow of said liquids is made possible.

6. The controller of claim 2 further including a pressure charging means in combination with said pressurizing means, whereby initial pressure charging and recharging of said liquids is accomplished, and an attached pressure line is eliminated and portability and ease of use is enhanced.

7. The controller of claim 2 wherein said orifices are changeable, whereby combining proportions are easily changed.

8. The controller of claim 2 wherein said orifices are preassembled and prepackaged with their corresponding container, liquid, and flow path, whereby all may be disposed of after use, without cleaning, and said orifices are unmistakably matched with said liquid, thereby providing user with convenience, quality, and choice of liquid components.

9. The controller of claim 2 wherein said containers are inverted and located at predetermined heights above said orifices, whereby the elevation pressure heads of the respective liquids provide a flow producing common pressure.

10. A controller for proportionally combining two or more simultaneously flowing liquids comprising:

a. a port for receiving one of said liquids under pressure, as from a garden hose, and b. containers, separately enclosing the remainder of said liquids, and c. in combination, said port and a pressurizing means making the pressure in said port common to said liquids, and d. a separate flow path in combination with a plurality of viscosity insensitive orifices of substantially common and relatively small diameter, for each of said liquids, whereby the coefficients of discharge of said orifices, for any of said liquids, maintain a substantially constant ratio relationship with those of said orifices associated with any other of said liquids, throughout the working flow rate range, and e. a junction of all flow paths for combining and discharging said liquids, whereby the relative proportions of the combining liquids remain substantially constant over the working flow rate range.

11. The controller of claim 10 further including a check valve for preventing back flow, incorporated into each flow path from said containers, upstream of said junction, whereby contamination of said liquids is prevented.

12. The controller of claim 10 further including a substantially impermeable, flexible bag in each of said containers, separating said liquids from said pressurizing means, whereby contamination of said liquids is prevented, pressurization is accomplished, and upward flow is enabled.

13. The controller of claim 10 wherein said orifices are changeable, whereby combining proportions are easily changed.

14. The controller of claim 10 wherein said orifices are preassembled and prepackaged with their corresponding container, liquid, and flow path, whereby all may be disposed of after use, without cleaning, and said orifices are unmistakably matched with said liquid, thereby providing user with convenience, quality, and choice of liquid components.

* * * * *